US006652269B1

(12) United States Patent
Stenger

(10) Patent No.: US 6,652,269 B1
(45) Date of Patent: Nov. 25, 2003

(54) WIND RESISTANT CANDLE

(76) Inventor: Earl M. Stenger, 24 Donore Sq., San Antonio, TX (US) 78229

( * ) Notice: Subject to any disclaimer, the term of this patent is extended or adjusted under 35 U.S.C. 154(b) by 0 days.

(21) Appl. No.: 10/292,209

(22) Filed: Nov. 12, 2002

(51) Int. Cl.[7] ..... F23D 3/18; C11C 5/00
(52) U.S. Cl. ..... 431/325; 431/288
(58) Field of Search ..... 431/126, 290, 431/325, 288, 289, 291, 292; 44/275

(56) References Cited

U.S. PATENT DOCUMENTS

| | | | | |
|---|---|---|---|---|
| 54,266 A | | 4/1866 | Wing | |
| 1,489,918 A | | 4/1924 | Boehm | |
| 2,184,666 A | * | 12/1939 | Fredericks | 431/325 |
| 2,818,718 A | | 1/1958 | Roberts | 67/22 |
| 2,829,511 A | * | 4/1958 | Oesterle et al. | 431/325 |
| 4,386,904 A | * | 6/1983 | Miyahara et al. | 431/126 |

FOREIGN PATENT DOCUMENTS

| | | | | |
|---|---|---|---|---|
| JP | 58049830 | | 3/1983 | F23Q/13/00 |
| JP | 5-320689 | * | 12/1993 | 431/325 |
| JP | 409003482 A | | 1/1997 | C11C/005/00 |

* cited by examiner

*Primary Examiner*—James C. Yeung
(74) *Attorney, Agent, or Firm*—Akin Gump Strauss Hauer & Feld, LLP

(57) ABSTRACT

A wind resistant candle having a base formed of a substance that, when sufficiently heated, produces a vapor. The base includes a wick that absorbs small amounts of a liquid form of the base substance. The wick is formed from a bundle of fibers that transform the substance of the base into a vapor and ignite the vapor when the fibers are sufficiently heated. At least one of the wick fibers is formed of a pyrophoric material.

18 Claims, 1 Drawing Sheet

WIND RESISTANT CANDLE

BACKGROUND OF INVENTION

1. Field of the Invention

The present invention relates generally to wind resistant candles and, more specifically, to a wick composition for such candles.

2. Description of the Related Art

Wind resistant candles commonly referred to as "trick" candles are known and used for entertainment purposes. Typically, these "trick" candles are easy to blow out, but will re-light unless additional measures are taken to permanently extinguish the flame. The "trick" candles are commonly placed on a birthday cake as a prank, e.g., "trick" candles are intended to be blown out by a person, and then to subsequently and unexpectedly re-light without requiring action from any observers. The candles are manufactured by sprinkling a powder consisting of a pyrophoric material (usually magnesium) around the periphery of the candle wick so as to be protected by liquid wax until needed. The magnesium powder granules are ignited by wick embers that remain when the candle is blown out. In turn, the ignited granules ignite paraffin vapor, thereby to "re-light the candle wick." The magnesium powder produces a "sparkle" that may add to the entertainment value of the candles. However, among other things, the "trick" candles may create an undesirable atmosphere for other types of events such as a quiet dinner a sophisticated social gathering in a residential home, etc. In addition, 'trick' candles fail to provide any functional uses and provide amusement for short periods of time only.

Many other problems and disadvantages of the prior art will become apparent to led in the art after comparing such prior art with the present invention as described herein.

SUMMARY OF THE INVENTION

A wind resistant candle having a base formed of a substance that, when sufficiently heated, produces a vapor. The base includes a wick that absorbs small amounts of a liquid form of the base substance. The wick is formed from a bundle of fibers that transform the substance of the base into a vapor and ignite the vapor when the fibers are sufficiently heated. At least one of the wick fibers is formed of a pyrophoric material.

In certain but not other embodiments, the wick of the wind resistant candle is a pyrophoric ribbon wrapped in a helical fashion about the remaining wick fibers. Alternatively, the wick is a pyrophoric rod positioned within the remaining wick fibers. The wick fibers may be braided, twisted, or otherwise combined to form the wick of the candle. In operation, the wick typically uses capillary action to absorb liquefied portions of the base, the base being oil, paraffin wax, beeswax, a natural fat, etc.

Various other aspects of the invention may be realized with a candle that has a wick formed from at least one pyrophoric metal strip and an absorbent material. A base is included that provides a source of hydrocarbon material to the wick such that the wick gradually absorbs a liquid portion of the hydrocarbon material, the wick supporting a resilient flame that is fueled by vaporized hydrocarbon material that is continuously vaporized when the absorbed liquid portions of the hydrocarbon material are sufficiently heated by the wick.

In certain embodiments, the absorbent material of the wick is braided around the pyrophoric metal strip, while in other embodiments the pyrophoric metal strip surrounds the absorbent material. The pyrophoric metal strip is often magnesium, but may be a magnesium-aluminum blend, or similar material.

Still other aspects of the present invention may be realized through a method for producing a persistent flame on a candle. The method involves, not necessarily in this order, coupling at least one pyrophoric fiber to an absorbent material to create a wick; disposing at least a portion of the wick into a fuel source; and lighting the wick such that a liquid form of the fuel source is absorbed into the wick and transformed into a vapor prior to being ignited by heat from the wick. The heat of the wick sustains a persistent flame at the wick and contributes, at least in part, to the heat of the wick.

Coupling the pyrophoric fiber to the absorbent material may be accomplished in a number of ways, e.g., by surrounding the absorbent material with the pyrophoric fiber, by surrounding the pyrophoric fiber with the absorbent material, by braiding the pyrophoric fiber with absorbent fibers that are used to create the absorbent material, etc.

Other systems, methods, features and advantages of the invention will be apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

A better understanding of the present invention can be obtained when the following detailed description of the preferred embodiment is considered in conjunction with the following figures.

The components in the figures are not necessarily to scale, emphasis instead laced upon illustrating the principles of the invention. In the figures, like reference numerals designate corresponding parts throughout the different views.

DETAILED DESCRIPTION OF THE PREFERRED EMBODIMENT

Figure 1:
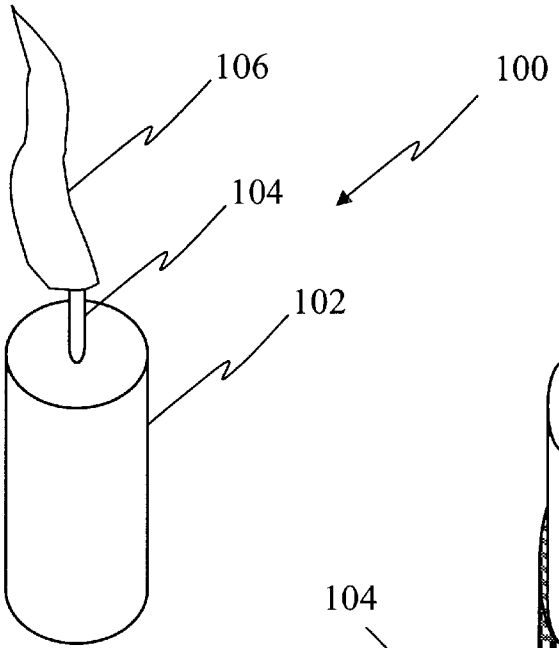
FIG. 1 illustrates a wind resistant candle that is constructed according to certain other principles of the present invention.

FIG. 1 illustrates a wind resistant candle 100 that is constructed according to certain but not other principles of the present invention. The candle 100 includes a base 102 and a wick 104. The base 102 is formed from a heavy hydrocarbon material such as paraffin wax but could be formed of other material such as beeswax, animal or other natural fat, a liquid form of oil held in a container, etc. The base 102 is essentially a fuel source that is consumed by a candle flame 106 at the wick 104.

The wick 104 is formed with absorbent material that draws fuel from the base 102, often through capillary action, toward the flame 106 of the candle 100. Frequently, the wick 104 is formed according to variables such as composition of the base 102, burn rate of the wick 104, etc. Accordingly, although other materials may be used for construction of the wick 104, for ease of understanding additional embodiments, the wick 104 is made from an absorbent material such as cotton interwoven with a thin strip of pyrophoric metal such as magnesium or aluminum-magnesium. Among other possibilities for the wick 104 construction, the thin strip of metal may be shaped as a helical ribbon surrounding the braided or twisted absorbent material, or the strip of metal may be a small rod surrounded by the absorbent material. In use, when the temperature is sufficiently elevated near the base 102, a liquid form of a portion of the base 102 that has been drawn into the absorbent material of the wick 104 is vaporized and burned to produce the flame 106 at the wick 104. The thin strip of metal in the wick 104 remains sufficiently heated to continue the ignition of vapor that is being produced from the base 102 at the wick 104. In certain but not other embodiments, the thin strip of metal remains heated because it does not contact the liquid form of the base 102 prior to vaporizing portions of the base 102.

The flame 106, unlike flames of the prior art, remains lit in the presence of substantial winds or other air movement, and can be enjoyed either indoors or out. In addition, among other things, the flame 106 preferably does not produce sparkles such as the sparkles that are seen in the "trick" candles of the prior art. The flame 106 is resilient and remains burning for at least the reason that the wick 104 remains at a sufficiently elevated temperature level to continuously ignite fuel vapor that is produced from the base 102. Further, unlike the "trick" candles of the prior art that are designed to be blown out and automatically re-ignited, the flame 106 is designed to remain lit for many hours of esthetic pleasure as well as functional use.

Figure 2:
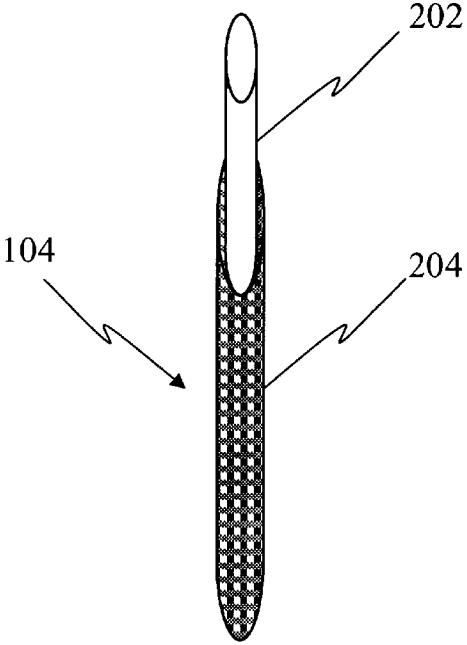
FIG. 2 illustrates a detailed diagram of one embodiment for the wick of the illustrated in FIG. 1.

FIG. 2 illustrates a detailed diagram of one embodiment for the wick 104 of the candle 100. The wick 104 includes a rod 202 surrounded by an absorbent material 204 that is used to draw fuel from the base 102. The rod 202 is commonly formed of a pyrophoric metal such as magnesium or the like and is approximately the size of fishing line, i.e., about 0.1 to 0.9 mm in diameter. The size of the rod 202 is such that the rod 202 is ignited and burns when the wick 104 of the candle is lit. Once the rod 202 is burning, the absorbent material 204 of the wick 104 contributes to the continuous burning of the rod 202, which in turn contributes to vaporization of the liquid form of the base 102 and subsequent appearance of the flame 106. This cycle repeats itself to support the flame 106 that is resilient to conventional methods for extinguishment. In other words, a liquefied portion of the base 102 is absorbed by the absorbent material 204 of the wick 104, which is vaporized by the heat of the absorbent material 204. The vaporized portion of the base 102 is ignited by the burning rod 202 which is kept burning by the resulting flame 106.

Figure 3:
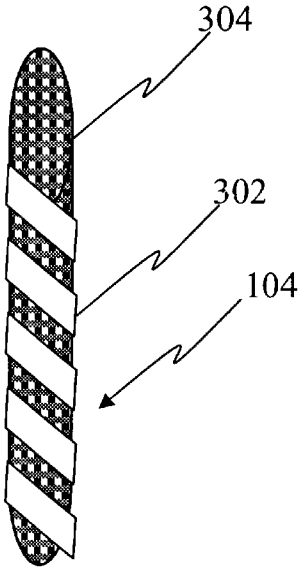
FIG. 3 is a diagram that illustrates yet another embodiment for the wick of the illustrated in FIG. 1.

FIG. 3 is a diagram that illustrates yet another embodiment for the wick 104 of the candle 100. In the wick 104 of FIG. 3, a helical strip of metal 302 wraps around an absorbent material 304. Similar to other embodiments described herein, the flame 106, the helical strip of metal 302, the absorbent material 304, and the base 102 all combine to support the continuous appearance of the flame 106.

Although a system and method according to the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

While various embodiments of the invention have been described, it will be apparent to those of ordinary skill in the art that many more embodiments and implementations are possible that are within the scope of this invention.

What is claimed is:

1. A wind resistant candle comprising:

a base formed of a substance that, when sufficiently heated, produces a vapor; and a wick disposed in the base that absorbs small amounts of a liquid form of the base substance, the wick formed from a bundle of fibers such that when the fibers are sufficiently heated, the substance of the base is transformed into a vapor and ignited, at least one of the wick fibers being formed of a pyrophoric material.

2. The wind resistant candle of claim 1 wherein the wick comprises a pyrophoric ribbon forming a helix around at least a portion of the remaining wick fibers.

3. The wind resistant candle of claim 1 wherein the wick comprises a pyrophoric rod disposed within the remaining wick fibers.

4. The wind resistant candle of claim 1 wherein the wick fibers are braided to form the wick of the candle.

5. The wind resistant candle of claim 1 wherein the wick fibers are twisted to form the wick of the candle.

6. The wind resistant candle of claim 1 wherein the wick uses capillary action to absorb liquefied portions of the base.

7. The wind resistant candle of claim 1 wherein the base is oil.

8. The wind resistant candle of claim 1 wherein the base is paraffin wax.

9. The wind resistant candle of claim 1 wherein the base is beeswax.

10. The wind resistant candle of claim 1 wherein the base is a natural fat.

11. A candle comprising:

a wick formed from at least one pyrophoric metal strip and an absorbent material; and a base providing a source of hydrocarbon material to the wick such that the wick gradually absorbs a liquid portion of the hydrocarbon material, the wick supporting a resilient flame that is fueled by vaporized hydrocarbon material that is continuously vaporized when the absorbed liquid portions of the hydrocarbon material are sufficiently heated by the wick.

12. The candle of claim 11 wherein the absorbent material of the wick is braided around the at least one pyrophoric metal strip.

13. The candle of claim 11 wherein the at least one pyrophoric metal strip is wrapped around at least a portion of the absorbent material of the wick.

14. The candle of claim 11 wherein the at least one pyrophoric metal strip is magnesium.

15. A method for producing a persistent flame on a candle comprising:

coupling at least one pyrophoric fiber to an absorbent material to form a wick;

disposing at least a portion of the wick into a fuel source; and lighting the wick such that a liquid form of the fuel source is absorbed into the wick and transformed into a vapor prior to being ignited by heat from the wick, the heat of the wick sustaining a persistent flame at the wick.

16. The method of claim 15 wherein coupling the at least one pyrophoric fiber to the absorbent material comprises surrounding the absorbent material with the at least one pyrophoric fiber.

17. The method of claim 15 wherein coupling the at least one pyrophoric fiber to the absorbent material comprises at least partially surrounding the at least one pyrophoric fiber with the absorbent material.

18. The method of claim 15 wherein coupling the at least one pyrophoric fiber to the absorbent material comprises braiding the at least one pyrophoric fiber with absorbent fibers that are used to create the absorbent material.

* * * * *